US008362408B2

(12) United States Patent
Carlson

(10) Patent No.: US 8,362,408 B2
(45) Date of Patent: Jan. 29, 2013

(54) STEERABLE PROJECTILE CHARGING SYSTEM

(75) Inventor: Robert J. Carlson, Brooklyn Park, MN (US)

(73) Assignee: Honeywell International Inc., Morristown, NJ (US)

( * ) Notice: Subject to any disclaimer, the term of this patent is extended or adjusted under 35 U.S.C. 154(b) by 595 days.

(21) Appl. No.: 12/603,725

(22) Filed: Oct. 22, 2009

(65) Prior Publication Data

US 2011/0094372 A1 Apr. 28, 2011

(51) Int. Cl.
*F41G 7/00* (2006.01)

(52) U.S. Cl. ..... 244/3.22

(58) Field of Classification Search ..... 244/3.21, 244/3.22, 3.23, 12.5
See application file for complete search history.

(56) References Cited

U.S. PATENT DOCUMENTS

| | | | | |
|---|---|---|---|---|
| 2,726,510 | A | 12/1955 | Goddard | |
| 3,245,620 | A | 4/1966 | McEwen | |
| 3,273,825 | A | 9/1966 | Kerner | |
| 3,764,091 | A | 10/1973 | Crowhurst | |
| 3,860,199 | A | 1/1975 | Dunne | |
| 4,431,150 | A | 2/1984 | Epperson, Jr. | |
| 4,441,670 | A | 4/1984 | Crepin | |
| 4,463,921 | A | 8/1984 | Metz | |
| 4,482,107 | A | 11/1984 | Metz | |
| 4,502,649 | A * | 3/1985 | Botwin et al. | 244/3.1 |
| 4,566,656 | A | 1/1986 | Maudal et al. | |
| 4,589,594 | A | 5/1986 | Kranz | |
| 4,632,336 | A | 12/1986 | Crepin | |
| 4,637,572 | A | 1/1987 | Metz | |
| 4,712,747 | A * | 12/1987 | Metz et al. | 244/3.22 |
| 5,016,835 | A * | 5/1991 | Kranz | 244/3.22 |
| 5,074,492 | A | 12/1991 | Morgand | |
| 5,123,611 | A * | 6/1992 | Morgand | 244/3.22 |
| 5,125,596 | A * | 6/1992 | Cavalleri | 244/3.22 |
| 5,456,425 | A * | 10/1995 | Morris et al. | 244/3.22 |
| 5,647,558 | A | 7/1997 | Linick | |
| 5,788,178 | A | 8/1998 | Barrett, Jr. | |
| 6,220,544 | B1 | 4/2001 | Dommer et al. | |
| 6,233,919 | B1 * | 5/2001 | Abel et al. | 60/204 |

(Continued)

FOREIGN PATENT DOCUMENTS

EP 0060726 3/1982

OTHER PUBLICATIONS

Sprengle et al. , "Excalibur: Extended-Range Precision for the Army", "Field Artillery", Mar.-Apr. 2003, pp. 13-16.

(Continued)

*Primary Examiner* — Tien Dinh
*Assistant Examiner* — Keith L Dixon
(74) *Attorney, Agent, or Firm* — Ingrassia Fisher & Lorenz, P.C.

(57) ABSTRACT

A steerable projectile comprises a pressure chamber to hold gas in a pressurized state; and a body section coupled to the pressure chamber, the body section having a flight system to use the pressurized gas for adjusting a trajectory of the projectile. The pressure chamber comprises an orifice in a wall of the pressure chamber; and a check valve corresponding to the orifice, the check valve configured to allow gas that results from ignition of a propellant to enter the pressure chamber via the corresponding orifice and to prevent the gas, once inside the pressure chamber, from exiting the pressure chamber via the corresponding orifice.

20 Claims, 5 Drawing Sheets

U.S. PATENT DOCUMENTS

| | | | | |
|---|---|---|---|---|
| 6,422,507 | B1 | 7/2002 | Lipeles | |
| 6,474,593 | B1 | 11/2002 | Lipeles et al. | |
| 6,629,668 | B1 | 10/2003 | Grau et al. | |
| 6,889,935 | B2 | 5/2005 | O'Dwyer | |
| 6,951,317 | B2 * | 10/2005 | Woessner et al. | 244/3.22 |
| 7,118,065 | B1 | 10/2006 | Heitmann et al. | |
| 7,354,017 | B2 | 4/2008 | Morris et al. | |

OTHER PUBLICATIONS

Thompson, Mark, "Pirates Beware: Soon Rifles That Kill Form a Mile Away", "http://www.time.com/time/nation/article/0,8599,1891348,00.html", Apr. 15, 2009, Publisher: TIME, Published in: Washington.

* cited by examiner

STEERABLE PROJECTILE CHARGING SYSTEM

BACKGROUND

There are different techniques for steering or guiding a projectile during flight. For example, guided projectiles can be fin-stabilized or spin-stabilized and can use internal and/or external air-actuated control methods. As used herein guided projectiles include, but are not limited to, bullets, artillery projectiles (e.g. shells and shots), and tube-launched missiles. The Defense Advanced Research Projects Agency (DARPA) EXtreme ACcuracy Tasked Ordinance (EXACTO) project and the United States Army's Excalibur artillery projectile are examples of systems which use guided projectiles.

Typical guided projectiles which use internal air-actuated control methods include a chemical gas generator which is responsible for generating pressurized gas. The pressurized gas is then released through one or more orifices in the projectile to adjust the trajectory of the projectile. However, the chemicals used to generate the gas have a limited shelf-life which means that the guided projectile must either be used or replaced periodically. In addition, the components necessary for generating the pressurized gas and controlling the amount of pressure of the generated gas can be costly.

SUMMARY

In one embodiment, a steerable projectile is provided. The steerable projectile comprises a pressure chamber to hold gas in a pressurized state; and a body section coupled to the pressure chamber, the body section having a flight system to use the pressurized gas for adjusting a trajectory of the projectile. The pressure chamber comprises an orifice in a wall of the pressure chamber; and a check valve corresponding to the orifice, the check valve configured to allow gas that results from ignition of a propellant to enter the pressure chamber via the corresponding orifice and to prevent the gas, once inside the pressure chamber, from exiting the pressure chamber via the corresponding orifice.

DRAWINGS

Understanding that the drawings depict only exemplary embodiments and are not therefore to be considered limiting in scope, the exemplary embodiments will be described with additional specificity and detail through the use of the accompanying drawings, in which.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. The following detailed description is, therefore, not to be taken in a limiting sense.

The embodiments described below provide pressurized gas for use in an air-actuated control system of a guided projectile, also referred to herein as a steerable projectile. In particular, the embodiments described below have a practically limitless self-life. In addition, the embodiments described below substantially reduce the complexity of the gas generation system as compared to typical chemical gas generators.

Figure 1:
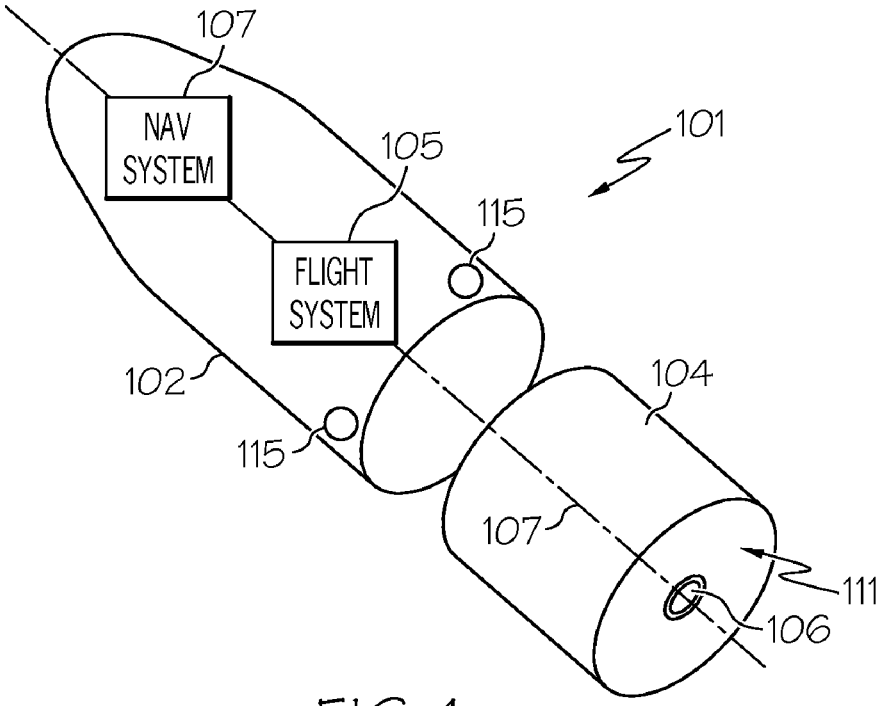
FIG. 1 is an exploded perspective view of one embodiment of a projectile.

FIG. 1 is an exploded perspective view of one embodiment of a projectile 101. The projectile 101 can be implemented, for example, as a bullet, an artillery shell, or a tube-launched missile. Notably, the projectile 101 is provided by way of example and not by way of limitation. In particular, the projectile 101 may include other components in addition to those shown in FIG. 1 when implemented.

The projectile 101 includes a body section 102 and a pressure chamber 104. The body section 102 includes flight system 105 and navigation or guidance system 107. Notably, flight system 105 and guidance system 107 are depicted in FIG. 1 by way of example. In particular, flight system 105 and guidance system 107 can be located in any portion of the body section 102. In this example, the body section 102 and the pressure chamber 104 are cylindrical. However, it is to be understood that, in other embodiments, the body section 102 and pressure chamber 104 are not required to be cylindrical.

Flight system 105 is configured to alter or adjust the flight path of projectile 101 based on information received from guidance system 107. In particular, the flight system 105 is an internal air-actuated control system which releases pressurized gas from one or more orifices 115 in the projectile 101 to control the trajectory of the projectile 101. For example, the release of the pressure may be a jet of gas that deflects the projectile as it exits orifices 115. In other embodiments, the pressurized gas is used to pop out a fin/control surface which steers the projectile 101. Suitable air-actuated flight control systems are known to one of skill in the art of guided projectiles. The guidance system 107 can be a laser-guided system, a radar-based tracking system, an infrared tracking system, an inertial measurement unit, a global positioning system (GPS) sensor, or any combination thereof, as known to one of skill in the art. In addition, one of skill in the art is aware of other appropriate guidance systems which can be used to implement guidance system 107.

The projectile 101 also includes a pressure chamber 104 which holds the pressurized gas used by flight system 105 to maneuver the projectile 101. The pressure chamber 104 includes an orifice 106 located along a center axis 107 of the pressure chamber 104. The orifice 106 is disposed in an external wall of the pressure chamber to permit gas from outside the pressure chamber 104 to enter the pressure chamber 104. In particular, when a propellant is ignited to propel the projectile 101 out of a tube, such as a gun barrel, an artillery cannon or a missile launch tube, the gas produced by the ignited propellant enters the pressure chamber 104 through the orifice 106. As used herein, a propellant is an explosive substance which produces a force when ignited that imparts motion to a projectile.

Hence, the projectile 101 does not need a chemical reaction gas generator as used in conventional guided projectiles. Since, the projectile 101 uses pressurized gas from the ignited propellant, the projectile 101 essentially has an unlimited shelf-life as long as the propellant can be ignited. In addition, the relative simplicity of the pressure chamber 104, as compared to typical gas generators, reduces the cost of manufacturing the projectile.

Figure 2:
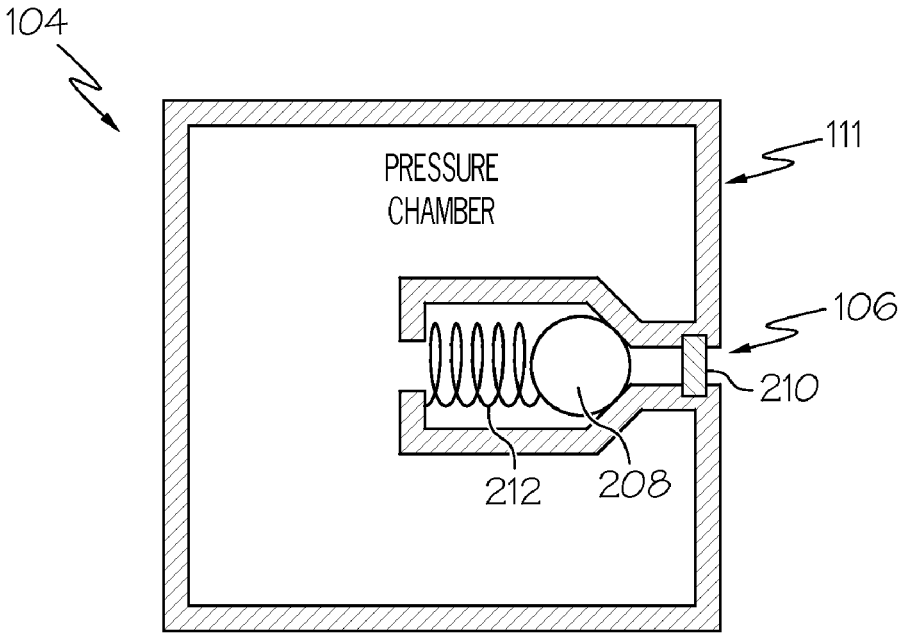
FIG. 2 is a cross-sectional view of one embodiment of a pressure chamber.

FIG. 2 is a cross-sectional view of one embodiment of the pressure chamber 104 used in the projectile 101. As shown in this exemplary embodiment, the pressure chamber 104 includes an orifice 106 and a check valve comprised of a spring 212 and a cover 208 coupled to the spring 212. In this example, the cover 208 is implemented as a sphere. However, it is to be understood that other shapes of the cover 208 can be used in other embodiments.

The cover 208 is configured to prevent gas from entering or leaving the pressure chamber 104 when it covers the orifice 106. In particular, based on its spring constant, the spring 212 provides a force on the cover 208 which causes the cover 208 to cover or block the orifice 206. When a propellant is ignited, the pressure from the explosion provides enough force to overcome the force applied on the cover 208 by the spring 212. Thus, the pressure from the ignited propellant moves the cover 208 to open the orifice 106 and allow gas to enter the pressure chamber 104. Gas continues to enter the chamber 104 until the pressure of the gas reaches a desired range. In particular, if the pressure in the chamber 104 is too low, the projectile 101 will not steer well. However, if the pressure is too high, the pressurized gas can rupture the wall of the pressure chamber 104. Once the desired range is reached, the spring 212 will then cause the cover 208 to press against and cover the orifice 106 to prevent entry or exit of more gas through the orifice 106. Since the ignition of the propellant will generally produce more than sufficient pressure, the lower pressure limit is controlled by the spring 212 and cover 208 which prevent the pressurized gas from exiting the pressure chamber 104. The upper pressure limit is controlled by the diameter of the orifice 106, the value of the external pressure produced by ignition of the propellant, and the time the external pressure is applied.

In addition, the pressure chamber 104 optionally includes a filter 210. The filter 210 is needed in embodiments in which particles in the gas from the propellant could clog or block channels in the flight system 105 through which the pressurized gas travels. For example, in the embodiment of FIG. 2, the filter 210 is placed at the opening of the orifice 106 to prevent the particles from entering the pressure chamber 104. However, in other embodiments, the filter 210 can be placed in other locations. For example, in one embodiment, the filter 210 is placed at an opening through which the gas in the pressure chamber exits to the flight system 105 leaving the particles in the pressure chamber 104.

Figure 3:
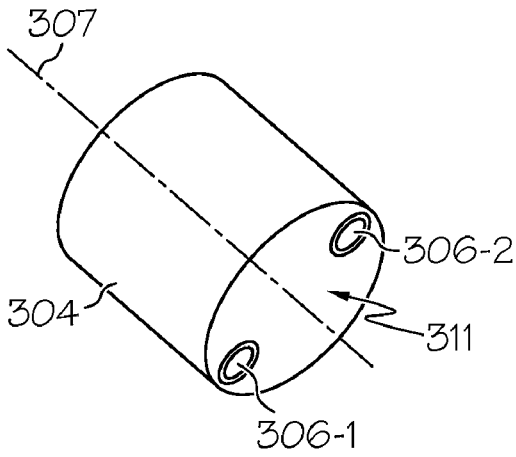
FIG. 3 is a perspective view of another embodiment of a pressure chamber.

Furthermore, although a single orifice 106 is shown in FIGS. 1 and 2, it is to be understood that in other embodiments more than one orifice can be used. For example, in FIGS. 3 and 4, another embodiment of a pressure chamber 304 has two orifices 306-1 and 306-2. Orifices 306-1 and 306-2 are placed along the perimeter of the pressure chamber 304 and located symmetrically about the center axis 307 of the pressure chamber 304. By placing the orifice along the perimeter of the pressure chamber 304, the center of the back surface 311 of the pressure chamber 304 can be used for other purposes, such as for sensors used for laser-guidance.

Figure 4:
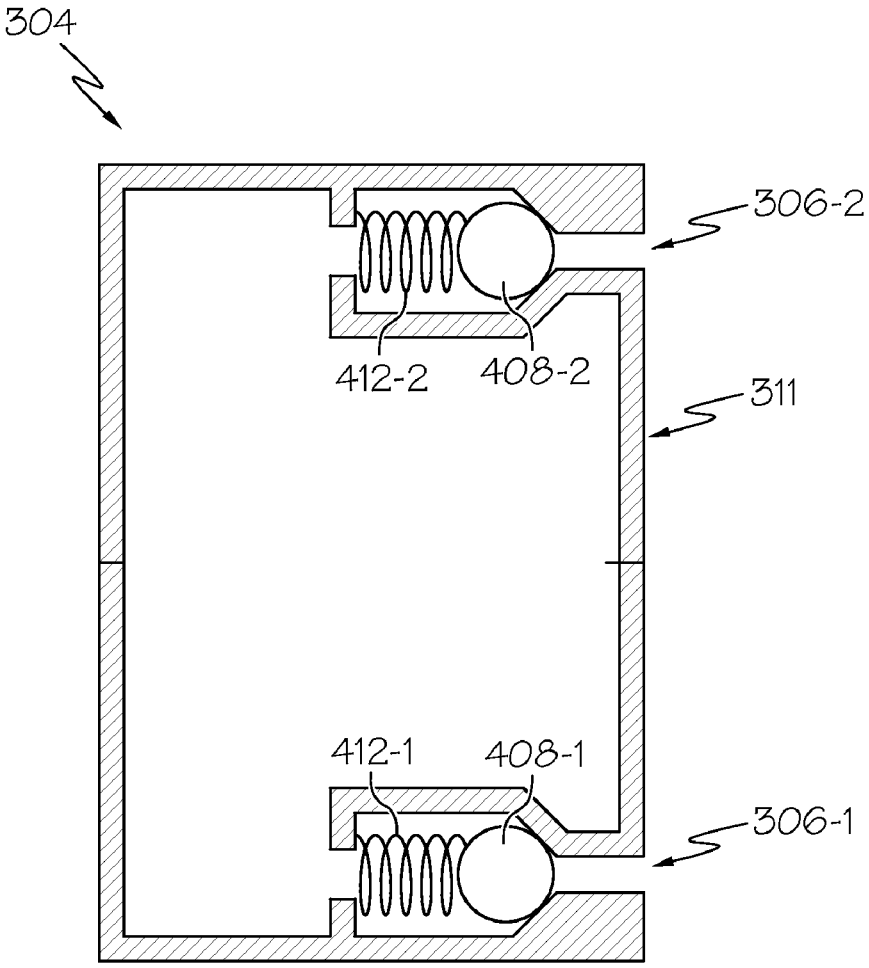
FIG. 4 is a cross-sectional view of the pressure chamber of FIG. 3.
Figure 5:
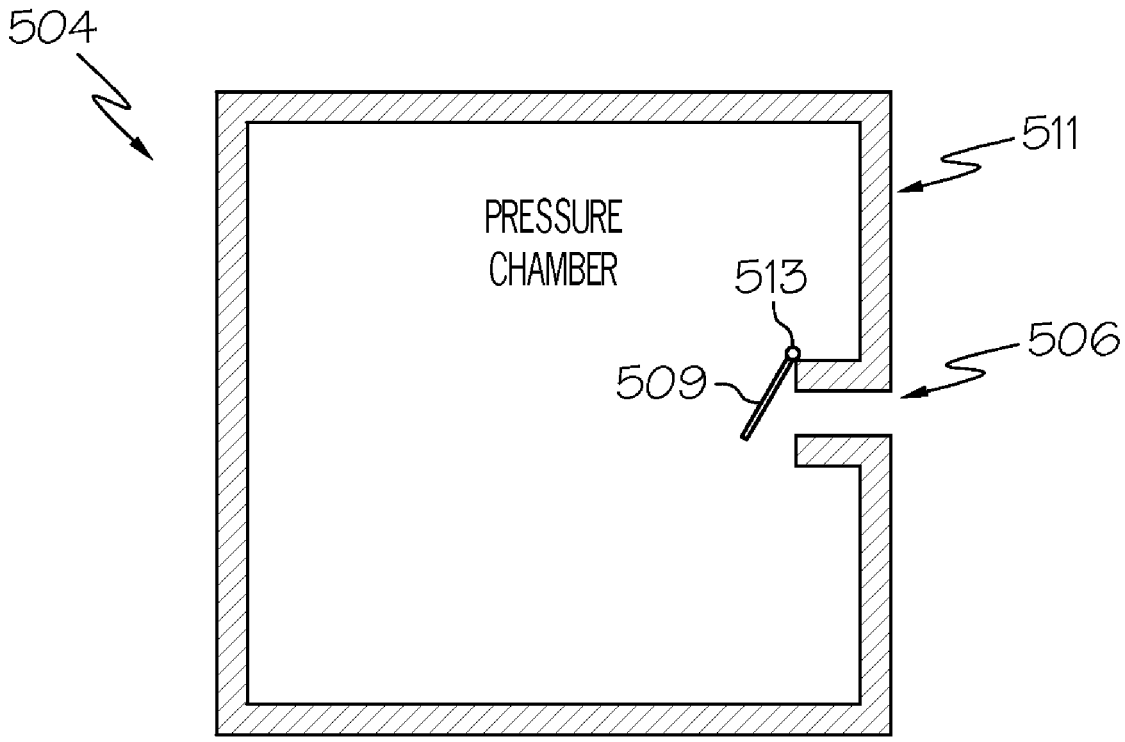
FIG. 5 is a cross-sectional view of another embodiment of a pressure chamber.

As shown in the cross-sectional view of FIG. 4, the pressure chamber 304 includes a check valve for each orifice 306. The check valve for each orifice 306 includes a spring 412 and a cover 408 as described above with respect to FIG. 2. It should be noted that, although a spring and cover are shown and described herein, the check valve for each orifice 306 can be implemented in other ways. For example, a flap and joint can be used in other embodiments, as shown in FIG. 5. Furthermore, although two orifices 306 are shown in this example, more than two orifices symmetrically placed about the center axis 307 can be used in other embodiments.

FIG. 5 is a cross-sectional view of another embodiment of a pressure chamber 504. In the exemplary pressure chamber 504, the check valve is implemented as a flap 509 and a joint 513. The joint 513 is biased to a position that maintains the flap 509 in a position to close or block the orifice 506. Hence, the flap 509 and joint 513 prevent pressurized gas inside the pressure chamber 504 from exiting through the orifice 506 similar to the spring 212 and cover 208 discussed above. Additionally, gas that results from the ignition of a propellant is able to enter the pressure chamber 504 by providing enough force to overcome the bias in the joint 513. Also, in the example of FIG. 5, the optional filter is not included in the pressure chamber.

Figure 6:
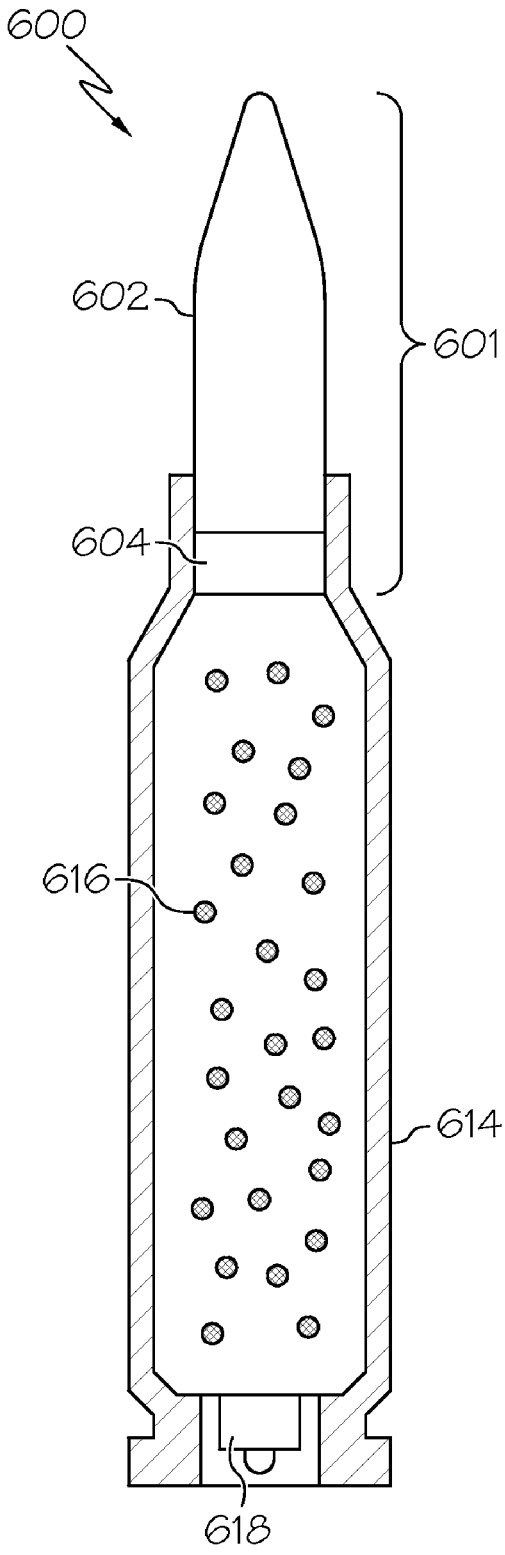
FIG. 6 is a block diagram of one embodiment of a projectile cartridge.

FIG. 6 is a block diagram of an exemplary embodiment of a projectile cartridge 600. The projectile cartridge can be a bullet cartridge or an artillery projectile cartridge. The projectile cartridge 600 includes a projectile 601, casing or shell 614, propellant 616, and primer 618. The projectile 601 is disposed in an opening in a first end of the casing 614 and the primer 618 is disposed in a second end of the casing 614. The propellant 616 is disposed within a cavity formed by the casing 614 as shown in FIG. 6.

The primer 618 is used to ignite the propellant 616 located in the casing 614 as known to one of skill in the art. The pressure that results from igniting the propellant 616 forces the projectile 601 out of the casing 614 and out of a tube such as a gun barrel or artillery canon. In addition, the projectile 601 includes a body section 602 and a pressure chamber 604 similar to the exemplary embodiments of a body section and a pressure chamber described above. In particular, the pressure that results from igniting the propellant 616 also causes the pressure chamber 604 to be filled with gas as described above. The projectile 601 then uses the pressurized gas in pressure chamber 604 for controlling the trajectory of the projectile 601 during flight as described above.

Figure 7:
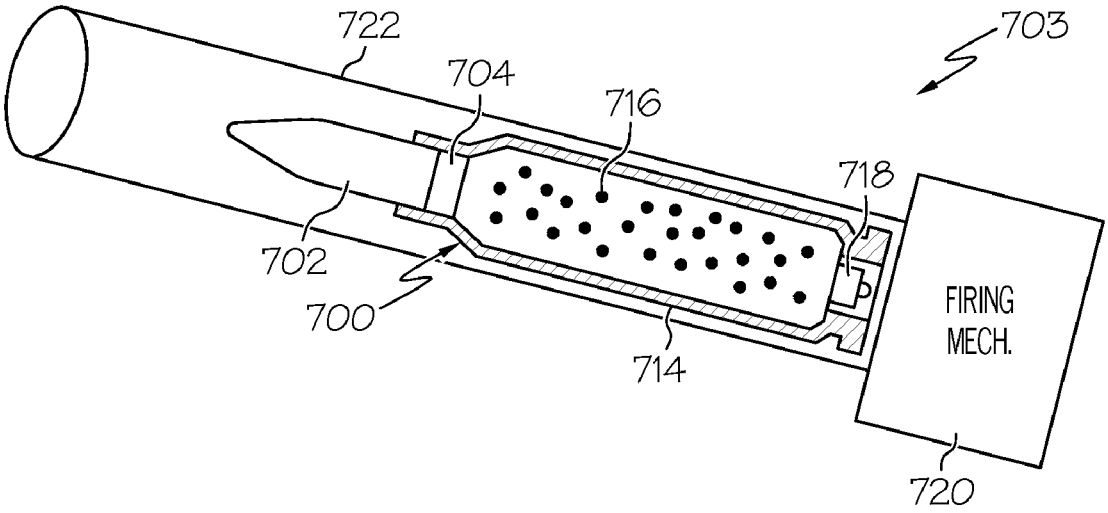
FIG. 7 is a block diagram of one embodiment of a projectile launching system.

FIG. 7 is a block diagram of one embodiment of a projectile launching system 703. The projectile launching system includes a projectile 701, a tube 722, a propellant 716, and a firing mechanism 720. The projectile 701 includes a body section 702 and a pressure chamber 704 similar to the exemplary embodiments of a body section and a pressure chamber described above. In this embodiment, the projectile 701 is part of a projectile cartridge 700 similar to projectile cartridge 600 described above. In particular, the projectile 701 is disposed in an opening in a first end of a casing 714 and a primer is disposed in a second end of the casing 714. A propellant 716 is disposed inside the casing 714. However, it is to be understood that projectile launching system 703 is provided by way of example only. In particular, in some embodiments, the projectile 701 is not part of a projectile cartridge. For example, projectile 701 can be implemented as a tube-launched missile. In such embodiments, the propellant 716 is located in a section of the projectile 701. Alternatively, in other embodiments, a projectile, such as an artillery shot can be placed in a tube 722 without a cartridge. In such a case, the propellant 716 is loaded into the tube 722 separately.

The firing mechanism 720 causes the propellant to ignite which propels the projectile 701 out of the tube 722. For example, in some embodiments, the tube 722 is implemented as a gun barrel and the projectile 701 is a bullet. In such a case, the firing mechanism is a hammer which strikes the primer 718 to ignite the propellant 716. The ignition of the propellant 716, thus, causes the bullet to be propelled out of the barrel. In other embodiments, the tube 722 is an artillery canon and the projectile 701 is an artillery shell. The gas produced by the ignition of the propellant 716 enters the pressure chamber 704, as described above.

A flight system in the projectile 701 uses the pressurized gas to adjust the trajectory of the projectile 701, as described above, and known to one of skill in the art. Hence, as described above, the projectile 701 has a substantially limitless shelf-life since it does not depend on chemical reactions to generate the pressurized gas as in typical guided projectiles. In addition, the projectile 701 is relatively less expensive to manufacture by leveraging the pressure produced by the ignited propellant 716 to fill the pressure chamber 704 with pressurized gas.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A steerable projectile that uses pressurized gas for guidance during flight, the steerable projectile comprising:

a pressure chamber to hold the pressurized gas; and a body section coupled to the pressure chamber, the body section having a flight system to use the pressurized gas for adjusting a trajectory of the steerable projectile;

wherein the pressure chamber comprises:

an orifice in a wall of the pressure chamber; and a check valve communicating with the orifice, the check valve configured to allow the pressurized gas that results from ignition of a propellant to enter the pressure chamber via the orifice and to prevent the pressurized gas, once inside the pressure chamber, from exiting the pressure chamber via the orifice, whereby external pressure produced by ignition of the propellant moves the check valve to open the orifice permitting entry of the pressurized gas into the pressure chamber and the orifice is closed in response to pressure from a portion of the check valve, wherein a lower pressure limit in the pressure chamber is controlled by the check valve and an upper pressure limit is at least partially controlled by a diameter of the orifice.

2. The steerable projectile of claim 1 wherein the steerable projectile is one of a bullet and an artillery shell.

3. The steerable projectile of claim 1, wherein the check valve comprises:

a spring having a spring constant; and a cover coupled to the spring, the cover being configured to close the orifice in response to pressure from the spring to prevent the pressurized gas from exiting the pressure chamber.

4. The steerable projectile of claim 1, wherein the check valve comprises a first check valve and the orifice comprises a first orifice, wherein the steerable projectile further comprises:

a second orifice in the wall of the pressure chamber, the second and first orifices disposed symmetrically about a center axis of the steerable projectile; and a second check valve communicating with the second orifice, the second check valve configured to allow the pressurized gas that results from ignition of the propellant to enter the pressure chamber via the second orifice and to prevent the pressurized gas, once inside the pressure chamber, from exiting the pressure chamber via the second orifice.

5. The steerable projectile of claim 1, wherein the check valve comprises a flap and a joint, the joint biased to a position which causes the flap to cover the orifice.

6. The steerable projectile of claim 1, further comprising a filter configured to filter particles contained in the pressurized gas that results from ignition of the propellant.

7. The steerable projectile of claim 6, wherein the filter is disposed in the orifice.

8. A projectile cartridge comprising:

a casing having an opening in a first end of the casing;

a propellant disposed within the casing;

a primer disposed within a second end of the casing, the primer configured to cause the propellant to ignite;

a projectile disposed within the opening in the first end of the casing such that ignition of the propellant causes the projectile to be propelled out of the casing, the projectile comprising:

a pressure chamber to hold pressurized gas; and a body section coupled to the pressure chamber, the body section having a flight system to use the pressurized gas for adjusting a trajectory of the projectile;

wherein the pressure chamber comprises:

an orifice in a wall of the pressure chamber; and a check valve communicating with the orifice, the check valve configured to allow the pressurized gas that results from ignition of the propellant to enter the pressure chamber via the orifice and to prevent the pressurized gas, once inside the pressure chamber, from exiting the pressure chamber via the orifice, whereby external pressure produced by ignition of the propellant moves the check valve to open the orifice permitting entry of the pressurized gas into the pressure chamber and the orifice is closed in response to pressure from a portion of the check valve, wherein a lower pressure limit in the pressure chamber is controlled by the check valve and an upper pressure limit is at least partially controlled by a diameter of the orifice.

9. The projectile cartridge of claim 8 wherein the projectile is one of a bullet and an artillery shell.

10. The projectile cartridge of claim 8, wherein the check valve comprises:

a spring having a spring constant; and a cover coupled to the spring, the cover being configured to close the orifice in response to pressure from the spring to prevent the pressurized gas from exiting the pressure chamber.

11. The projectile cartridge of claim 8, wherein the check valve comprises a first check valve and the orifice comprises a first orifice, wherein the projectile further comprises:

a second orifice in the wall of the pressure chamber, the second and first orifices disposed symmetrically about a center axis of the steerable projectile; and a second check valve communicating with the second orifice, the second check valve configured to allow the pressurized gas that results from ignition of the propellant to enter the pressure chamber via the second orifice and to prevent the pressurized gas, once inside the pressure chamber, from exiting the pressure chamber via the second orifice.

12. The projectile cartridge of claim 8, wherein the check valve comprises a flap and a joint, the joint biased to a position which causes the flap to cover the orifice.

13. The projectile cartridge of claim 8, wherein the projectile further comprises a filter configured to filter particles contained in the pressurized gas that results from ignition of the propellant.

14. The projectile cartridge of claim 13, wherein the filter is disposed in the orifice.

15. A projectile launching system comprising:

a projectile comprising a pressure chamber to hold pressurized gas and a body section coupled to the pressure chamber, the body section having a flight system to use the pressurized gas for adjusting a trajectory of the projectile;

a tube having an opening in a first end of the tube, the tube configured to receive the projectile;

a propellant to propel the projectile out of the opening in the first end of the tube when the propellant is ignited; and a firing mechanism to cause the propellant to ignite;

wherein the pressure chamber of the projectile comprises:

an orifice in a wall of the pressure chamber; and a check valve the orifice, the check valve configured to allow the pressurized gas that results from ignition of the propellant to enter the pressure chamber via the orifice and to prevent the pressurized gas, once inside the pressure chamber, from exiting the pressure chamber via the orifice, whereby external pressure produced by ignition of the propellant moves the check valve to open the orifice permitting entry of the pressurized gas into the pressure chamber and the orifice is closed in response to pressure from a portion of the check valve, wherein a lower pressure limit in the pressure chamber is controlled by the check valve and an upper pressure limit is at least partially controlled by a diameter of the orifice.

16. The projectile launching system of claim 15, further comprising: a casing having an opening in a first end of the casing, wherein the projectile is disposed within the opening in the first end of the casing and the propellant is disposed within the casing; and a primer disposed within a second end of the casing, the primer responsive to the firing mechanism to cause the propellant to ignite;

wherein, when the propellant is ignited, the propellant causes the projectile to be propelled out of the opening in the first end of the casing and out of the tube.

17. The projectile launching system of claim 15, wherein the check valve comprises:

a spring having a spring constant; and a cover coupled to the spring, the cover being configured to close the orifice in response to pressure from the spring to prevent the pressurized gas from exiting the pressure chamber.

18. The projectile launching system of claim 15, wherein the check valve comprises a first check valve and the orifice comprises a first orifice, wherein the projectile further comprises:

a second orifice in the wall of the pressure chamber, the second and first orifices disposed symmetrically about a center axis of the steerable projectile; and a second check valve communicating with the second orifice, the second check valve configured to allow the pressurized gas that results from ignition of the propellant to enter the pressure chamber via the second orifice and to prevent the pressurized gas, once inside the pressure chamber, from exiting the pressure chamber via the second orifice.

19. The projectile launching system of claim 15, wherein the projectile further comprises a filter configured to filter particles contained in the pressurized gas that results from ignition of the propellant.

20. The projectile launching system of claim 15, wherein the check valve comprises a flap and a joint, the joint biased to a position which causes the flap to cover the orifice.

* * * * *